US009061533B2

(12) United States Patent
McHugh

(10) Patent No.: US 9,061,533 B2
(45) Date of Patent: Jun. 23, 2015

(54) LABEL INFORMATION DEGRADER

(71) Applicant: Thomas Richard McHugh, Westerly, RI (US)

(72) Inventor: Thomas Richard McHugh, Westerly, RI (US)

( * ) Notice: Subject to any disclaimer, the term of this patent is extended or adjusted under 35 U.S.C. 154(b) by 68 days.

(21) Appl. No.: 13/794,792

(22) Filed: Mar. 12, 2013

(65) Prior Publication Data

US 2014/0273770 A1 Sep. 18, 2014

(51) Int. Cl.
*B24B 23/02* (2006.01)
*B41M 7/00* (2006.01)

(52) U.S. Cl.
CPC ..... *B41M 7/0009* (2013.01); *B24B 23/02* (2013.01)

(58) Field of Classification Search
CPC ..... B24B 23/00; B24B 23/02
USPC ..... 451/358, 344, 72, 443, 444, 456, 453, 451/454, 359
See application file for complete search history.

(56) References Cited

U.S. PATENT DOCUMENTS

| | | | | |
|---|---|---|---|---|
| 1,325,937 | A | 12/1919 | Fox | |
| 1,426,765 | A | 8/1922 | Pesarillo | |
| 1,759,104 | A * | 5/1930 | Ergle | 451/358 |
| 1,829,582 | A | 10/1931 | Carson | |
| 2,740,977 | A | 4/1956 | Allen | |
| 2,773,337 | A * | 12/1956 | De Marchi Arturo | 451/352 |
| 2,812,529 | A | 11/1957 | Payne | |
| 3,368,635 | A | 2/1968 | Harman | |
| 3,793,782 | A | 2/1974 | Bowling | |
| 5,176,478 | A * | 1/1993 | Munch | 409/137 |
| 6,817,932 | B2 | 11/2004 | Furey | |
| 7,412,999 | B2 * | 8/2008 | Lvovskiy et al. | 156/762 |
| 7,571,509 | B2 | 8/2009 | Rosenzweig | |
| 8,459,578 | B1 * | 6/2013 | Fischer | 241/14 |
| 2006/0084370 | A1 * | 4/2006 | Robieu et al. | 451/359 |

* cited by examiner

*Primary Examiner* — Robert Rose
(74) *Attorney, Agent, or Firm* — Daniel Vakili

(57) ABSTRACT

A label information degrader for substantially and permanently degrading the legibility of label information on a label attached to a container, said label information degrader including an abrasion component positioned to contact the label of the container during use, an abrasion cleaning component, a powered drive component that rotates the abrasion component and may rotate the abrasion cleaning component, a housing component that positions and provides direct or indirect structural support to the device components, and one or more user protection components, designed to avoid unintended user contact or injury from the label information degrader.

11 Claims, 9 Drawing Sheets

LABEL INFORMATION DEGRADER

CROSS-REFERENCE TO RELATED APPLICATIONS

This application does not claim priority to any other non-provisional or international application.

STATEMENT REGARDING FEDERALLY SPONSORED RESEARCH OR DEVELOPMENT

This application was not made with the aid of any federally sponsored research and development.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates to a label information degrader (LID) for substantially and permanently degrading the legibility of label information on a labeled surface. The present invention may also substantially remove the label from the surface.

Unauthorized access to personal information can lead to adverse and dramatic consequences, such as identity theft or medical identity theft. The Federal Trade Commission recommends that people "[s]hred outdated health insurance forms, prescription and physician statements, and the labels from prescription bottles before you throw them out." Reference at http://www.consumer.ftc.gov/articles/0171-medical-identity-theft (previously found at http://www.ftc.gov/bcp/edu/pubs/consumer/idtheft/idt10.shtm). Also, even where a container label does not contain personal information, it may need to be degraded or removed for an alternate use or for recycling. Further, the removal or degradation of a label from a surface may be desirable before relabeling a surface, to prevent confusion if the new label becomes dislodged or is unintentionally removed.

Existing methods of label degradation are cumbersome and unwieldy. Often the user is put at risk of injury. Simple scrapers or knives have limited effectiveness on many label types and may slip during the removal process, with the potential of cutting the user. Additionally, a simple scraper may provide a very limited contact area when used to remove a label from a labeled surface. More complex label removal systems may become fouled by laminated labels, with the label removal component becoming fouled by label adhesive. Wet removal methods may employ hazardous chemicals, require long soak or contact times, and result in undesirable waste solutions for disposal.

Alternatives to label degradation may not be adequate. Merely covering over an existing label poses a risk that the new label could become dislodged, unintentionally removed, or even intentionally removed. This is even true where a "permanent" marker ink is used to black out label information, as there are a variety of methods available to remove the ink or view the writing underneath the ink, such as commercially available products like the "Mr. Clean® Magic Eraser®" or the careful application of a solvent like acetone.

The above provided background information is for informational purposes only and should not be considered admissions that the mentioned information or publications are prior art.

BRIEF SUMMARY OF THE INVENTION

This invention teaches a Label Information Degrader (LID) comprising at least: an abrasion component; an abrasion cleaning component that contacts the abrasion component and limits debris build up on the abrasion component, a powered drive component that rotates the abrasion component and may rotate the abrasion cleaning component, a housing component, and one or more user protection components.

The abrasion component has an abrasion contact surface that will contact a label on a surface. The abrasion component has an axis of rotation. While rotating and in contact with a labeled surface, the abrasion contact surface will at least substantially render the information on the label illegible and may also substantially detach the label from the surface. The abrasion component may also be designed to substantially conform to the labeled surface, to increase contact with the label, and provide greater abrasion efficiency.

The abrasion cleaning component contacts at least the abrasion contact surface, to clean the abrasion contact surface and limit label or other surface debris build up on the abrasion component.

The powered drive component that rotates the abrasion component and may also rotate the abrasion cleaning component.

The housing component that positions and provides direct or indirect structural support to the device components.

The user protection component or components may limit unintended contact with the abrasion contact surface of the abrasion component, including potentially harmful contact with the user.

Thus, the invention teaches a device that effectively degrades label information by substantially rendering the information on the label illegible or substantially detaching the label from surface, while providing substantial user protection from the abrasion components.

BRIEF DESCRIPTION OF THE SEVERAL VIEWS OF THE DRAWING

The views of the drawings below show two embodiments of the invention, and two embodiments of the abrasion component.

The word "External" when used to describe a drawing refers to drawings or views that depict what can be seen with the Label Information Degrader (LID) fully assembled, presumably in an operable state. The word "Internal" when used to describe a drawing refers to any drawing where portions of the LID have been removed to provide an internal view of the LID configuration.

DETAILED DESCRIPTION OF THE INVENTION

Figure 1:
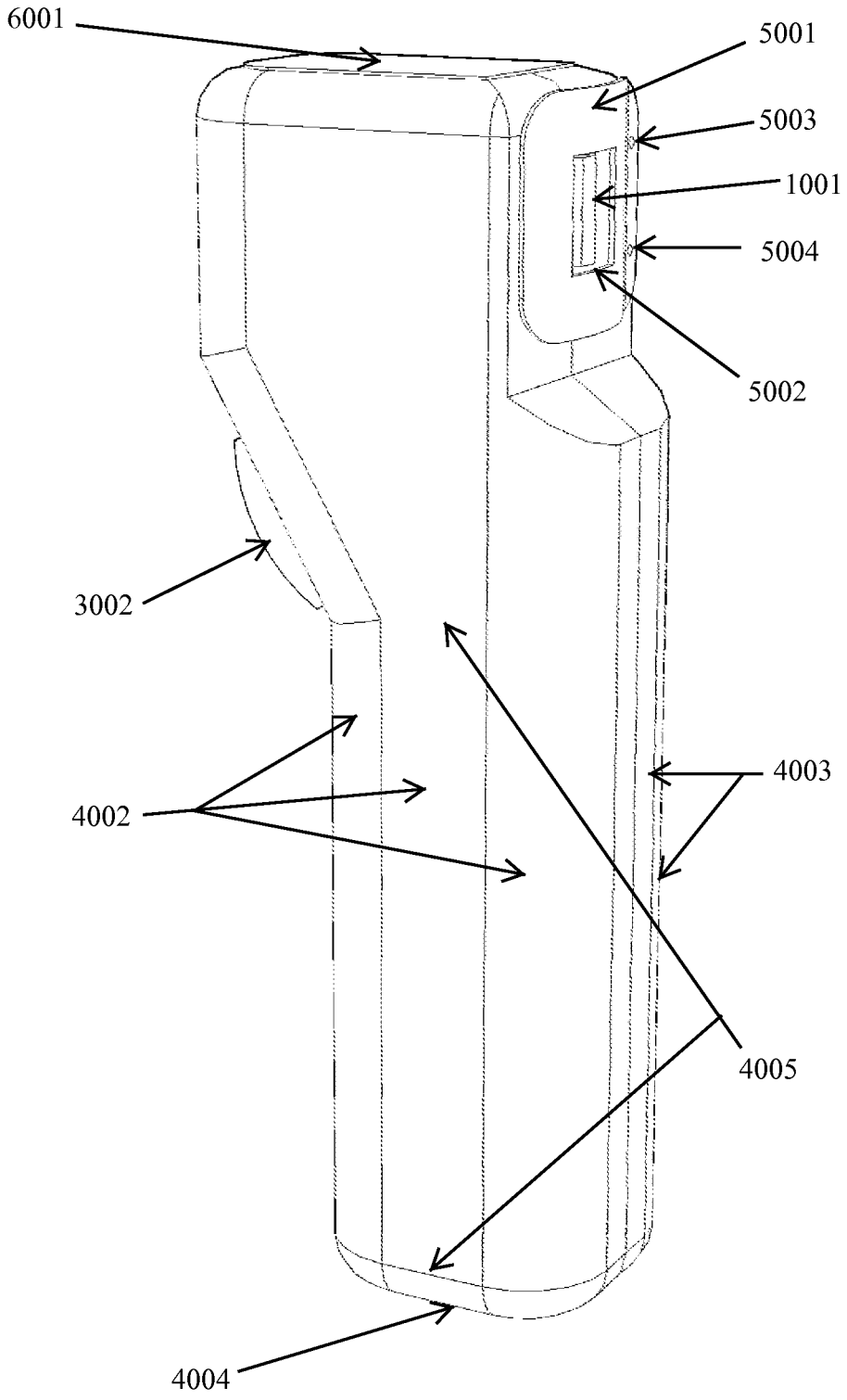
FIG. 1 External First Side View, LID Embodiment 1
FIG. 2 External Second Side View, LID Embodiment 1
FIG. 3 Internal First Side View, LID Embodiment 1
FIG. 4 External Right Side View, LID Embodiment 2
FIG. 5 Internal Right Side View, LID Embodiment 2
FIG. 6 Internal Left Side View, LID Embodiment 2
FIG. 7 Abrasion Component, Component Embodiment 1200
FIG. 8 Abrasion Component, Component Embodiment 1300
FIG. 9 Abrasion Component, Component Embodiment 1400

While the basic Label Information Degrader (LID) will comprise an abrasion component, an abrasion cleaning component, a powered drive component, a housing component, and one or more user protection components, there are many possible preferred embodiments of the LID, which may feature either additional components, specific configurations of described components, or both. Using the disclosed information a person skilled in the art would understand this invention comprises many different combinations of the disclosed components, disclosed embodiments or compatible partial combinations of those embodiments, especially when optimizing a device for a particular use or operating conditions.

Generally, any abrasion component will function in the LID provided the abrasion component has a surface that will degrade label information from a labeled surface and the abrasion component is configured to be mounted in the LID such that when connected to an active powered drive component, the abrasion component will rotate and contact a presented labeled surface, and sufficiently accommodate the function of the other LID components. There are many possible abrasion component configurations that are compatible with the present invention, and the descriptions provided below are not meant to exclude or limit compatible configurations from the present invention.

The abrasion component may be comprised of several element types or combinations of those types. For example, the abrasion component may be comprised of an abrasion contact surface, abrasion support element(s), and abrasion power transfer element(s). The abrasion component may be designed to be rigid, or the abrasion component may instead be designed to flex.

Where the abrasion component is designed to flex, the abrasion contact surface may at least partially conform to a labeled surface when pressed against the label of a surface, which will provide greater abrasion contact for a labeled surface that contains irregularities or where the labeled surface is not flat such as a curved surface. An abrasion component that is designed to flex may be comprised of one or more element types, which will allow the abrasion contact surface to at least partially conform to a labeled surface.

The abrasion contact surface is designed to contact a labeled surface, substantially render the information on the label illegible, and may also substantially detach the label from the surface. The abrasion contact surface may be designed to be rigid, or the abrasion contact surface may instead be designed to flex such that the supported abrasion contact surface may accommodate irregularities or curvature in the labeled surface and may provide increased contact area during the label degradation process.

The support element(s) are designed to support the abrasion contact surface as it contacts the labeled surface. The support element(s) may be designed to be rigid, or the support element(s) may instead be designed to flex such that the supported abrasion contact surface may accommodate irregularities or curvature in the labeled surface and may provide increased contact area during the label degradation process.

The power transfer element(s) are designed to receive mechanical power from the powered drive component, rotate the support element(s), rotate the abrasion contact element(s), and ultimately cause the rotation of the abrasion contact surface against the labeled surface.

The abrasion component may be designed to shear off large pieces of the label at once, or advantageously to incrementally remove a label from a surface by shearing away fine particles. By designing the abrasion component to shear away fine particles at least two advantages are realized: the labeled information is irretrievably destroyed and the fine label dust tends to coat any label adhesive that may be present, which limits the degree the label adheres to LID components and surfaces.

Specific embodiments or descriptions of the abrasion components have been described below, but are not intended to be limiting or define all abrasion component elements in each embodiment; rather, they are set forth to illustrate and define some options for the design of the abrasion component. Modifications of the disclosed abrasion component options that incorporate the spirit and substance of the invention may occur to persons skilled in the art, thus the invention should be construed to include everything within the disclosed application, scope of the appended claims, or equivalents thereof.

In one embodiment where the support elements are designed to flex, the abrasion component may comprise an inner shaft having an axis of rotation, designed to receive mechanical power from the powered drive component, a plurality of disks mounted with a flexible sub-element around the inner shaft, each with an exterior edge and an interior edge, and a plurality of circular abrasion sub-elements, each with an exterior abrasion edge and an interior circular opening, the interior circular opening mounted around the exterior edge of the disks. The plurality of circular abrasion sub-elements may be arranged such that the exterior abrasion edges are staggered to improve performance, such as by providing a more consistent load on the motor and creating greater shear forces on the label surfaces.

The plurality of disks may be each comprised of an inner disk, with an inner disk exterior edge and an inner disk interior edge, an outer disk, with an outer disk exterior edge and an outer disk interior edge, with the flexible sub-element comprising a plurality of flexible spokes, each spoke affixed at one end to the inner disk exterior edge and at the other end to the outer disk interior edge. By varying characteristics of the spokes such as curvature, thickness and width, and materials of construction, the desired level of flexibility may be achieved.

In another embodiment where the support element is designed to flex, the plurality of disks may be mounted using an elastic substrate such as an elastomer. For instance, the abrasion component may comprise a rigid inner shaft having an axis of rotation, an elastic elastomer tube forming a sleeve around the rigid shaft, a plurality of circular abrasion elements, each with an exterior circular cutting edge and an interior circular opening, the plurality of abrasion elements mounted around the elastic elastomer tube.

In another embodiment, the abrasion component may be comprised of stiff bristles mounted around a cylindrical support element, to form a generally cylindrical brush head that will rotate when mounted in the LID. The stiffness of the bristles may be rigid, or instead be designed to flex and conform, by varying characteristics such as bristle stiffness, length, or other characteristics. The bristles may be made of any material sufficient to degrade a labeled surface, such as metal wire, plastic, any other suitable material, or combination of materials. The bristles may be placed in any number of configurations, with some combinations potentially improving label degradation rates, power consumption, or other performance related criteria. The cylindrical support element may be of any suitable construction, and may be rigid or designed to flex.

In another embodiment, the abrasion contact surface may be comprised of an abrasion material mounted around a cylindrical support element, to form a generally cylindrical abrasion contact surface that will rotate when mounted in the LID. Many types of abrasion material may be compatible such as a scouring pad, steel wool, or sand paper. The cylindrical support element may be of any suitable construction, and may be rigid or designed to flex. The rigidity of the abrasion component will depend on the material used and the design of the support element; a person skilled in the art would be able to create rigid and flexible designs using the contemplated abrasion materials and cylindrical support elements.

The abrasion component may be designed to drive label debris or surface debris towards a debris collection area in the LID or out of the device. The configuration and positioning of the abrasion component may be such that debris is directly pushed by the abrasion component towards a debris collection area. The abrasion component configuration and positioning in the LID, may cooperate with other components such as the housing, abrasion cleaning, powered drive, and debris collection components, to directly or indirectly convey label debris or surface debris towards a debris collection area or out of the device.

Generally, any abrasion cleaning component will function in the LID provided it can be positioned to contact the abrasion component to remove excess debris from the abrasion contact surface or limit other surface debris accumulation on the abrasion contact surface. There are many possible abrasion cleaning component configurations that are compatible with the present invention, and the descriptions provided below are not meant to exclude or limit compatible configurations from the present invention.

The abrasion cleaning component may comprise static, dynamic, or a combination of static abrasion cleaning elements and dynamic abrasion cleaning elements positioned to contact the abrasion component, and remove at least some label debris from the abrasion contact surface to prevent accumulation on and fouling of the abrasion contact surface.

Static abrasion cleaning elements do not rotate when the LID is in operation, but are affixed and supported by the housing component, positioned to contact the abrasion component, and remove at least some label debris from the abrasion contact surface to prevent accumulation on and fouling of the abrasion contact surface.

Dynamic abrasion cleaning elements rotate while the device is in operation. The rotation of the dynamic abrasion cleaning component may be achieved through contact with the abrasion component. In such a configuration, friction or drag between the abrasion cleaning component, housing component, and abrasion component will cause the dynamic abrasion component to rotate, with some degree of slippage between the surfaces of the abrasion component and dynamic abrasion cleaning component. As the abrasion contact surface slips over the dynamic abrasion cleaning component surfaces, at least some label debris from the abrasion contact surface will be removed to prevent accumulation on and fouling of the abrasion contact surfaces.

Alternatively, the dynamic abrasion cleaning component may be configured to be mounted in the LID with a connection to the powered drive component. In such a configuration, the dynamic abrasion cleaning element may rotate based on power transmission that is not dependent on contact with the abrasion component. Thus, the dynamic abrasion cleaning component would still contact and slip over the abrasion contact surface of the abrasion component and remove at least some label debris from the abrasion contact surface to prevent accumulation on and fouling of the abrasion contact surfaces. Powered rotation of the abrasion cleaning component allows the abrasion cleaning component rotation to be set at a rate faster or slower than the abrasion component rotation.

The configuration and position of one or more LID components including the abrasion component, abrasion cleaning component, housing component, powered drive component, and an optional debris collection component may be such to facilitate deposit of label debris or surface debris in the debris collection area of the LID and limit label or surface debris from entering other areas of the LID. This may be accomplished by direct contact with debris or by generating air flow that aids in conveying the debris to the debris collection component. Advantageously, the abrasion cleaning component may cooperate with one or more LID components to exclude at least a portion of the label or surface debris removed from the abrasion contact surface from entering the inside of the LID.

In one embodiment, the LID has at least a dynamic abrasion cleaning component with a connection to the powered drive component and the rotation of the dynamic abrasion cleaning component is in the same direction as the abrasion component but at a higher rate of speed, to minimize wear on the abrasion component and abrasion cleaning component while effectively removing debris from the abrasion contact surface.

Generally, any powered drive component will function in the LID provided that it may be adapted to rotate the abrasion component and, in some embodiments, also rotate the abrasion cleaning component. There are many possible powered drive component configurations that are compatible with the present invention, and the descriptions provided below are not meant to exclude or limit compatible configurations from the present invention.

The powered drive component may contain a motor and a transmission. The motor will receive power from either an external or internal power source. The motor and power source contemplated will be any motor and power source that are compatible with each other, known or developed in the future, which may be suitably incorporated for use in the LID. If the power source is electrical, the power source may be either AC such as would be supplied externally via an outlet or DC such as would be supplied internally by one or more rechargeable or non-rechargeable batteries.

If the power source is electrical and supplied from one or more batteries, one skilled in the art would be able to practice this invention with many possible battery configurations by comparing the motor power requirements with possible battery outputs such as those supplied by combinations of commercially available batteries, including but not limited to AA, C, D, and 9 volt batteries The transmission may be any transmission that can rotate the abrasion component and may rotate the abrasion cleaning component, such as a belt, gear, or coupling system. The transmission system may be configured to advantageously rotate the abrasion cleaning component and abrasion component in the same direction to reduce wear on these components, where the abrasion cleaning component has at least one dynamic abrasion cleaning component.

Advantageously, additional safety and device protection may be included into the LID device design where the transmission utilizes an anti-stall component in-line to transmit mechanical power to the abrasion component and/or the abrasion cleaning component. This is accomplished by designing the transmission to allow the anti-stall component to slip in an operating condition where the motor would otherwise stall, such if there is a high friction condition between the abrasion component and label surface. There are several known components that could be configured to allow the motor to continue rotating including, but not limited to, a belt or coupling, rather than forcing an energized motor to stop if the abrasion component stops.

The powered drive component may allow the user to reverse the rotational direction of the abrasion component and/or the abrasion cleaning component.

The powered drive component may allow the user to increase or decrease the rotational speed of the abrasion component and/or the abrasion cleaning component. One skilled in the art could achieve this through stepping up or down the supplied voltage to the motor, by using resistors, or by mechanical gearing which may provide additional torque at lower speed rotation.

In some embodiments, the configuration and position of elements of the powered drive component may cooperate with other LID components to facilitate debris collection in the debris collection component and limit label or surface debris from entering other areas of the LID. This may be accomplished by generating air flow that aids in conveying the debris to the debris collection component.

Generally, any housing component will function in the LID provided it can be adapted to directly or indirectly support the device components. There are many possible housing component configurations that are compatible with the present invention, and the descriptions below are not meant to exclude or limit compatible configurations from the present invention.

The housing component may position and provide direct or indirect structural support to the device components. In some embodiments, the housing component may have an exterior shell that prevents unintended contact with other device components. The exterior shell may have access panels to allow user access to portions of the device, such as for debris removal, changing batteries, or access to the abrasion component.

In some embodiments, the housing component may be configured to limit the depth that the abrasion contact surface may penetrate into a surface. This penetration depth may be fixed in some embodiments, while in others the housing component may be designed to allow the user to adjust the penetration depth.

In one embodiment where the penetration depth is fixed, the housing component has an exterior shell with an opening for the abrasion contact surface, which acts to limit the depth the abrasion contact surface may penetrate a surface. The housing component provides structural support to the abrasion component and the exterior shell. The housing component positions the rotating abrasion component, such that the abrasion contact surface extends a set distance past the opening in the exterior shell. Thus, the exterior shell around the abrasion contact surface acts as a stop and substantially limits the depth that the abrasion contact surface may penetrate a surface to the set distance. This may also be achieved with a user protection component.

In one embodiment where the user may adjust the penetration depth, the user may adjust and set the distance that the abrasion contact surface extends past the opening in the exterior shell. One way this may be accomplished is by designing the portion of the exterior shell with the opening for the abrasion contact surface to be movable, such that the distance the abrasion contact surface extends past the opening in the exterior shell may be adjusted and set by the user. The housing will provide structural support for all of the exterior shell, including the movable part of the exterior shell.

In some embodiments, the configuration and position of elements of the housing component may cooperate with other LID components to facilitate debris collection in the debris collection component and limit label or surface debris from entering other areas of the LID. Elements of the housing component may accomplish this by directing air flow generated by other components that aids in conveying the debris to the debris collection component. The housing component may also cooperate with other LID components to exclude at least some of the label or surface debris from entering the inside of the LID.

The housing component may have chambers designed to isolate one or more LID components from each other. This is especially desirable for minimizing migration of label debris from the abrasion component and abrasion cleaning component to areas of the powered drive component and especially the motor. In one embodiment where the housing component has chambers, the abrasion component and abrasion cleaning component are located in a chamber with a debris collection area and are substantially isolated from the powered drive component. Necessary mechanical power transmission into the isolated chamber could be provided in multiples ways, in a manner that minimizes debris migration out of the chamber, such as by using couplings that form a substantial seal with the chamber while allowing a rotating shaft to penetrate the chamber.

Generally, any user protection component or components will function in the LID provided the component or components limit unintended user contact with the abrasion component or any part of the LID that might cause injury to the user. There are many possible user protection component configurations that are compatible with the present invention, and the descriptions below are not meant to exclude or limit compatible configurations from the present invention.

In some embodiments, user protection may be facilitated by configuring the housing and abrasion component such that only a small area of the abrasion component is exposed.

The user protection component or components may limit user exposure to the abrasion contact surface of the abrasion component. One way the user protection component may function is to limit contact with the abrasion contact surface until enough pressure is applied to the user protection component.

In some embodiments, user protection may be achieved by utilizing a transmission with an anti-stall component in-line to transmit mechanical power to the abrasion component and/or the abrasion cleaning component. User protection is facilitated by setting the anti-stall component to slip if the shearing force at the abrasion contact surface exceeds the requirements to degrade a label, thus stopping the abrasion and limiting potential hazard to a user. There are several known components that could be configured to allow the motor to continue rotating while the abrasion component is stopped including, but not limited to, a belt or coupling.

In one embodiment, a compressible element with an opening for the abrasion contact surface is affixed to the exterior shell of the housing and may substantially obstruct contact with the abrasion contact surface until sufficient pressure is applied to compress the compressible element. This element will limit accidental exposure to the abrasion contact surface.

In another embodiment, user protection from the abrasion component is achieved through the combination of the abrasion component and the housing component. By positioning the abrasion component relative to the housing component, such that the abrasion component is capable of penetrating a surface only a limited amount, e.g. the expected thickness of a label, contact with the abrasion contact surface of the abrasion component is inherently limited to safe amount under normal operating conditions.

Generally, the LID may include a debris collection component designed to collect and contain label and surface debris dislodged by the abrasion contact surface and/or the abrasion cleaning component. There are many possible debris collection component configurations that are compatible with the present invention, and the descriptions below are not meant to exclude or limit compatible configurations from the present invention.

In some embodiments, the debris removed from the abrasion contact surface by the abrasion cleaning component may collect inside the LID. To allow removal of debris from within the LID, an access panel may be positioned near the abrasion and abrasion cleaning components.

In some embodiments, the device may include a debris collection component, designed to collect debris for removal and limit debris from entering other areas of the LID. Portions of the debris collection component may contact the abrasion cleaning component and/or the abrasion component to facilitate the collection of debris. The debris collection component may be comprised of a separate component or components in the LID, but possible configurations include integrating all or part of the debris collection component into other components or structures in the LID, such as the housing component.

In some embodiments, the configuration and position of elements of the debris collection component may cooperate with other LID components to facilitate debris collection in an area of the LID and limit label or surface debris from entering other areas of the LID.

In some embodiments, particularly where there is no debris collection area within the LID, the configuration and position of other LID components such as the housing component, abrasion component, abrasion cleaning component, and powered drive component may be designed to limit label debris or surface debris from entering the interior of the LID and/or to expel such debris that does enter the LID. This could be accomplished through direct contact with debris from at least one device component, by channeling any component generated air flow, or both.

Generally, the LID may include one or more device protection components designed to prevent accidental damage to the LID device. There are many possible device protection component configurations that are compatible with the present invention, and the descriptions below are not meant to exclude or limit compatible configurations from the present invention.

In one embodiment, the LID may also have a device protection component such as a PC Control Board. The device protection component operates by detecting out of range conditions in LID. This may be caused by a number of issues such as an incompatible power source, a problem in the transmission, or a high friction condition between the abrasion component and label surface. In the event the device protection component detects an out of range condition, the device protection component may shut off power to one or more of LID components such as the motor, and may shut off all power to the LID.

In some embodiments, the device protection component may contain a user display. The user display may indicate the current status of the LID, including the presence of some or all of the out of range conditions. This may be accomplished by any number of ways known in the art such as the activation of an led light, which may be specifically associated with one or more of the occurring out of range condition(s). Despite the potential inclusion of the user display, there may be one or more out of range condition(s) that trigger a complete power shut off to the LID, including power to the user display.

In some embodiments, the device protection component may contain a reset switch. The reset switch will allow the user to attempt to reactivate the LID after an out of range condition. If the out of range condition persists, the device protection component may prevent the reactivation of the LID or instead the device protection component may shut off power to one or more of the components soon after reactivation.

In some embodiments, an anti-stall component is used in the transmission which may be configured to provide a measure of device protection, especially for the motor. In such a configuration, the anti-stall component of the transmission is designed to slip and allow the motor to continue to rotate when an operating condition exists that stops the abrasion component and/or the abrasion cleaning component.

The supported device feature combinations listed in the specification, depicted in the drawings, or identified as preferred embodiments are not limiting. Using the disclosed information a person skilled in the art would understand this invention comprises many different combinations of disclosed components, disclosed embodiments or compatible partial combinations of those embodiments, especially when optimizing a device for a particular use or operating conditions. Thus, the disclosure as a whole should be taken as providing support for any compatible combination or partial combination of disclosed components or disclosed embodiments that include at least an abrasion component, an abrasion cleaning component, a powered drive component, a housing component, and a user protection component, as well as any of the disclosed additional components such as a debris collection component or device protection component.

For instance, possible examples of LID devices include an embodiment comprising: an abrasion component, with an abrasion contact surface; a powered drive component, comprising an electric motor, adapted to rotate at least the abrasion component and abrasion contact surface; an abrasion cleaning component, positioned to contact the abrasion contact surface; a user protection component, adapted to limit unintended user contact with the abrasion contact surface; a housing component, adapted to provide structural support to the abrasion component, the powered drive component, the abrasion cleaning component, and user protection component.

That embodiment could include additional components or further specified versions of components. For example, the above embodiment may be further claimed such that the abrasion contact surface at least partially conforms to a labeled surface. Alternatively, the above embodiment may be further claimed such that the housing component includes an abrasion component housing opening, and the abrasion component is positioned relative to the abrasion component housing opening such that the abrasion component is capable of penetrating a surface only a limited and fixed amount. But, the specification would also support claiming an embodiment such that the housing component includes an abrasion component housing opening, and the abrasion component is positioned relative to the abrasion component housing opening such that the abrasion component is capable of penetrating a surface only a limited and fixed amount, but without having the abrasion contact surface that at least partially conforms to a labeled surface.

Thus, the specification provides support for claiming additional components or further specified versions of components independently, as well as together. This example is included not as an exhaustive list of how the different combinations of disclosed components, disclosed embodiments or compatible partial combinations of those embodiments may be claimed. Modifications of the LID component options, or combinations thereof, that incorporate the spirit and substance of the invention may occur to persons skilled in the art, thus the invention should be construed to include everything within the disclosed application, scope of the appended claims, or equivalents thereof.

PREFERRED EMBODIMENT DETAILED DESCRIPTIONS

FIG. 1 is an external view from the first side of a Label Information Degrader (LID), embodiment 1. From this view several major components or elements of those components that comprise the LID are visible or partially visible including: an abrasion component 1001; an external power switch 3002; a first side shell 4002; a second side shell 4003; a battery access panel 4004; a handle 4005; a compressible guard 5001; a guard opening 5002 positioned over the exposed portion of the abrasion component 1001; a first guard fastener location 5003; a second guard fastener location 5004; and, a debris collection component access panel 6001.

The abrasion component 1001 is not depicted as a specific abrasion component. Any abrasion component will function in the LID provided the abrasion component has a surface that will degrade label information from a labeled surface and the abrasion component is configured to be mounted in the LID such that when connected to an active powered drive component, the abrasion component will rotate, contact, and degrade information from a presented labeled surface, and sufficiently accommodate the function of the other LID components. There is no specific preferred embodiment for an abrasion component, as application variables such as label material, label adhesive, surface characteristics, and others will impact the design of a preferred embodiment. Additionally, there are many possible abrasion component configurations that are compatible with the present invention, and this embodiment, and the descriptions provided in this specification are not meant to exclude or limit compatible configurations from the present invention.

The housing component taken as a whole may be comprised of multiple parts, shown here with a first side shell 4002 and a second side shell 4003. In this view, the first side shell 4002 and the second side shell 4003, effectively shield the user from the internal mechanical and electrical components. A portion of the housing component may form a handle 4005, meant to include the portions of the first side shell 4002 and second side shell 4003 from approximately the location of the external power switch 3002 and battery access panel 4004. Any housing component will function in the LID provided it can be adapted to directly or indirectly support the device components, and the proper functioning of those components. There are many possible housing component configurations that are compatible with the present invention, and this embodiment, and the descriptions provided in this specification are not meant to exclude or limit compatible configurations from the present invention.

User protection is provided by the compressible guard 5001 with the guard opening 5002 positioned over the abrasion component 1001, and fastened to the second side shell 4003 at the first fastener location 5003 and the second fastener location 5004. The abrasion component 1001 is located below the plane formed by the guard opening 5002 when no pressure is applied to the compressible guard 5001. When pressure is applied to the compressible guard 5001, such as when the LID is pressed against a labeled surface, the compressible guard 5001 bends and a portion of the abrasion component 1001 is exposed sufficiently through the guard opening 5002 to contact a presented labeled surface. When pressure is released from the compressible guard 5001 it returns to its former position, which limits accidental user exposure to the abrasion component 1001.

Figure 2:
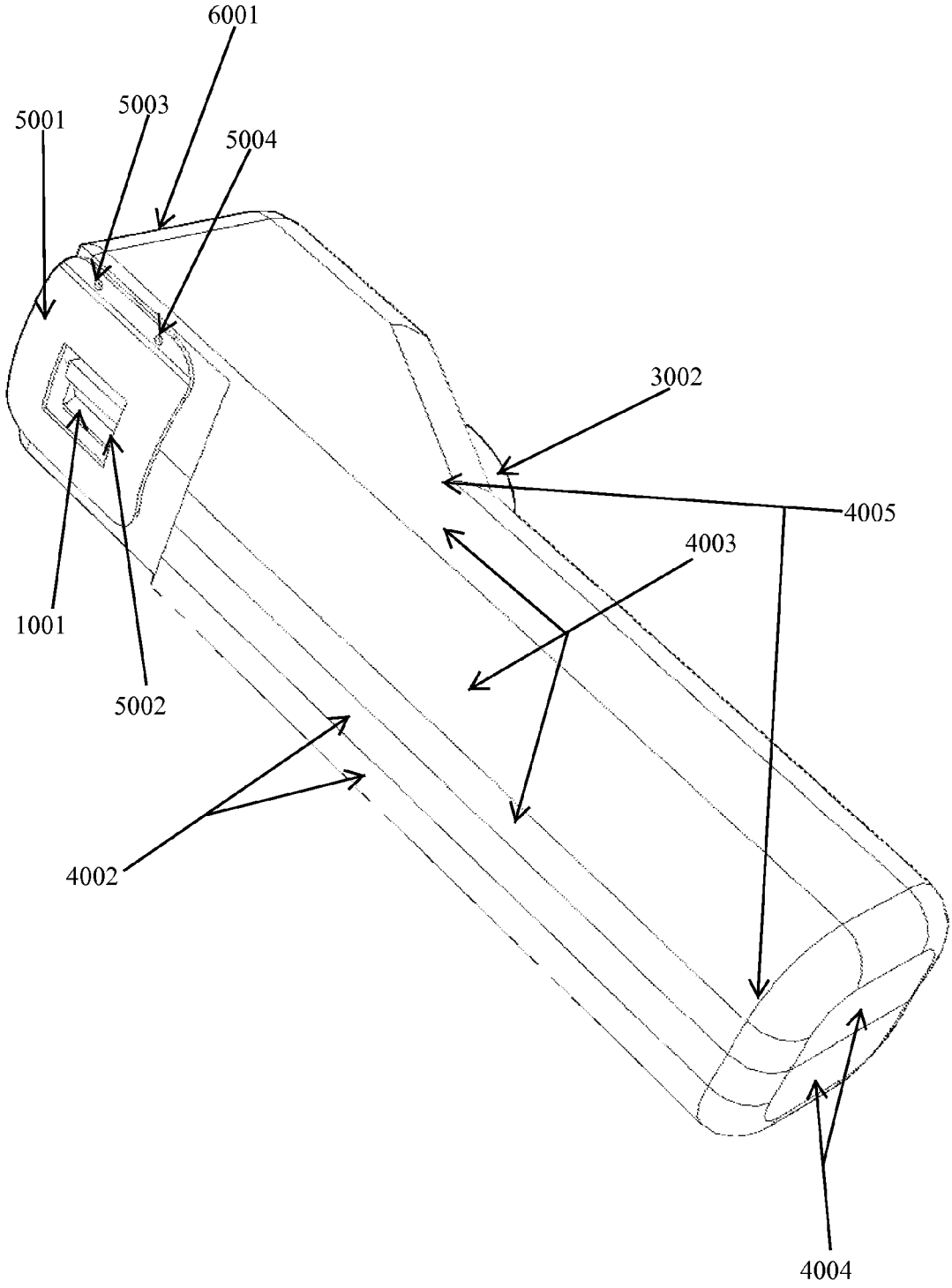

FIG. 2 is an external view from the left side of the LID, embodiment 1. From this view several major components or elements of those components that comprise the LID are visible or partially visible including: an abrasion component 1001; an external power switch 3002; a first side shell 4002; a second side shell 4003; a battery access panel 4004; a handle 4005; a compressible guard 5001; a guard opening 5002 positioned over the exposed portion of the abrasion component 1001; a first guard fastener location 5003; a second guard fastener location 5004; and, a debris collection component access panel 6001.

The abrasion component 1001 is not depicted as a specific abrasion component. Any abrasion component will function in the LID provided the abrasion component has a surface that will degrade label information from a labeled surface and the abrasion component is configured to be mounted in the LID such that when connected to an active powered drive component, the abrasion component will rotate, contact, and degrade information from a presented labeled surface, and sufficiently accommodate the function of the other LID components. There is no specific preferred embodiment for an abrasion component, as application variables such as label material, label adhesive, surface characteristics, and others will impact the design of a preferred embodiment. Additionally, there are many possible abrasion component configurations that are compatible with the present invention, and this embodiment, and the descriptions provided in this specification are not meant to exclude or limit compatible configurations from the present invention.

The housing component taken as a whole may be comprised of multiple parts, shown here with a first side shell 4002 and a second side shell 4003. In this view the first side shell 4002 and second side shell 4003, effectively shield the user from the internal mechanical and electrical components. A portion of the housing component may form a handle 4005, meant to include the portions of the first side shell 4002 and second side shell 4003 from approximately the location of the external power switch 3002 and battery access panel 4004. Any housing component will function in the LID provided it can be adapted to directly or indirectly support the device components, and the proper functioning of those components. There are many possible housing component configurations that are compatible with the present invention, and this embodiment, and the descriptions provided in this specification are not meant to exclude or limit compatible configurations from the present invention.

User protection is provided by the compressible guard 5001 with the guard opening 5002 positioned over the abrasion component 1001, and fastened to the second side shell 4003 at the first guard fastener location 5003 and the second guard fastener location 5004. The abrasion component 1001 is located below the plane formed by the guard opening 5002 when no pressure is applied to the compressible guard 5001. When pressure is applied to the compressible guard 5001, such as when the LID is pressed against a labeled surface, the compressible guard 5001 bends and a portion of the abrasion component 1001 is exposed sufficiently through the guard opening 5002 to contact a presented labeled surface. When pressure is released from the compressible guard 5001 it returns to its former position, which limits accidental user exposure to the abrasion component 1001.

Figure 3:
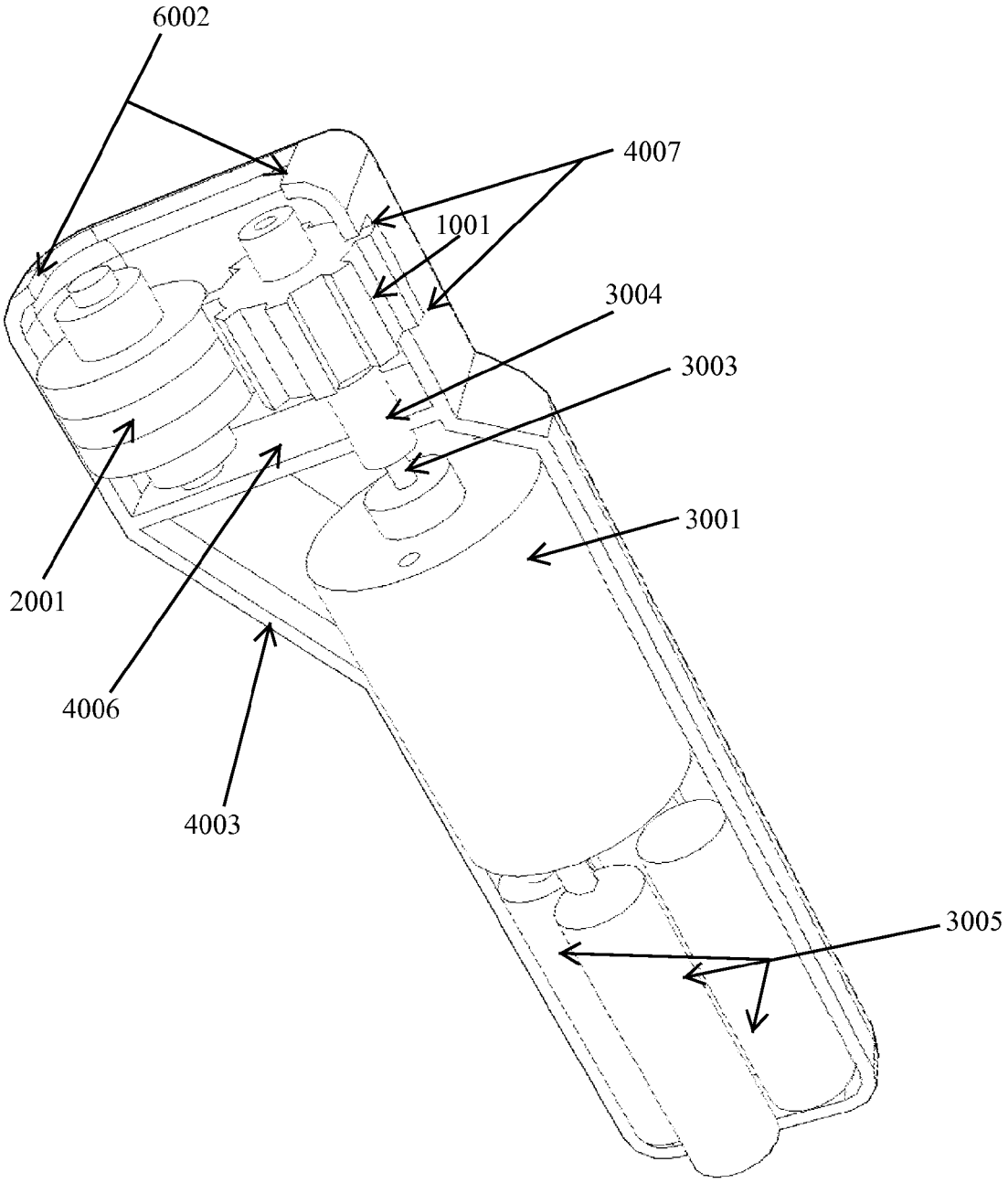

FIG. 3 is an internal view from the first side of a Label Information Degrader (LID), embodiment 1. Certain components or parts of components have been hidden to provide this view including: a external power switch 3002; a first side shell 4002; a battery access panel 4004; a compressible guard

5001; a guard opening 5002; a first fastener location 5003; a second fastener location 5004; and, a debris access panel 6001.

From this view several major components or elements of those components that comprise the LID are visible or partially visible including: an abrasion component 1001; an abrasion cleaning component 2001; a motor 3001; a motor drive shaft 3003; a coupling 3004; batteries 3005; a second side shell 4003; a part of a separating wall 4006; part of the abrasion component housing opening 4007; and a debris access opening 6002.

The abrasion component 1001 is not depicted as a specific abrasion component. In this view the support and specific mechanical drive are not shown. From the drawing and specification, a person skilled in the art would easily be able to configure mechanical transmission and sufficient structural support to build a working device, and make changes to optimize a device for a particular application. For instance, the debris access panel (shown in FIGS. 1 and 2) could alternatively be relocated on the side of either side shell 4002 or 4003, which may allow a drive shaft for the abrasion component 1001 to be affixed to a more rigid portion of the housing and have greater structural support. Alternatively, the debris access panel 6001 (shown in FIGS. 1 and 2) could be designed to provide removable support for the abrasion component 1001 and abrasion cleaning component 2001, and provide an easy access point for removing the abrasion component 1001 and abrasion cleaning component 2001, if the ability to easily remove them is desired, especially where a single LID is configured for use with different abrasion components.

Any abrasion component will function in the LID provided the abrasion component has a surface that will degrade label information from a labeled surface and the abrasion component is configured to be mounted in the LID such that when connected to an active powered drive component, the abrasion component will rotate, contact, and degrade information from a presented labeled surface, and sufficiently accommodate the function of the other LID components. There is no specific preferred embodiment for an abrasion component, as application variables such as label material, label adhesive, surface characteristics, and others will impact the design of a preferred embodiment. Additionally, there are many possible abrasion component configurations that are compatible with the present invention, and this embodiment, and the descriptions provided in this specification are not meant to exclude or limit compatible configurations from the present invention.

The abrasion cleaning component 2001 is not depicted as a specific abrasion cleaning component. In this embodiment, the abrasion cleaning component 2001 is dynamic, driven to rotate by contact with the abrasion component 1001. The specific support and specific mechanical drive are not shown. From the drawing and specification, a person skilled in the art would easily be able to configure mechanical transmission and sufficient structural support to build a working device and make changes to optimize a device for a particular application. As before, the debris access panel could be moved to gain certain design advantages at the expense of others. Any abrasion cleaning component will function in the LID provided it can be positioned to remove excess debris from the abrasion contact surface or limit other surface debris accumulation on the abrasion contact surface. Additionally, there are many possible abrasion cleaning component configurations that are compatible with the present invention, and this embodiment, and the descriptions provided in this specification are not meant to exclude or limit compatible configurations from the present invention.

The powered drive component is not depicted as a specific set of components. A generic motor 3001 is powered by batteries 3005. The motor 3001 turns a motor drive shaft 3003 which rotates an abrasion component drive shaft (not visible) through a coupling 3004. The coupling 3004 may be designed to allow the motor drive shaft 3003 slip in cases where the abrasion component 1001 stops and the motor 3001 is still energized and rotating. The electrical connections (not shown) in the LID, such as between the batteries 3005, motor 3001, and external power switch 3002 (shown in FIGS. 1 and 2), may be dependent on the specific choices of the components use to make the device. A person skilled in the art would be able to build a working device using the specification and drawings, and requirements of the selected components.

The first side shell 4002 (shown in FIGS. 1 and 2) and second side shell 4003 provide structural support to all of the components of the LID, and form an abrasion component housing opening 4007 (partially shown) through which the abrasion component 1001 penetrates.

In this view, the inside of the LID has two main compartments. A separating wall 4006 (partially shown) and a coupling 3004, prevent abrasion debris from reaching the motor 3001. The separating wall 4006 is pierced by the coupling 3004, which forms a substantial seal with the motor drive shaft 3003 and separating wall 4006.

In this embodiment, the debris collection component is comprised of the debris access opening 6002, the debris access panel 6001 (shown in FIGS. 1 and 2), and the chamber formed around the abrasion component 1001 and abrasion cleaning component 2001 substantially by the first side shell 4002 (shown in FIGS. 1 and 2), the second side shell 4003, and the separating wall 4006 (partially shown).

Figure 4:
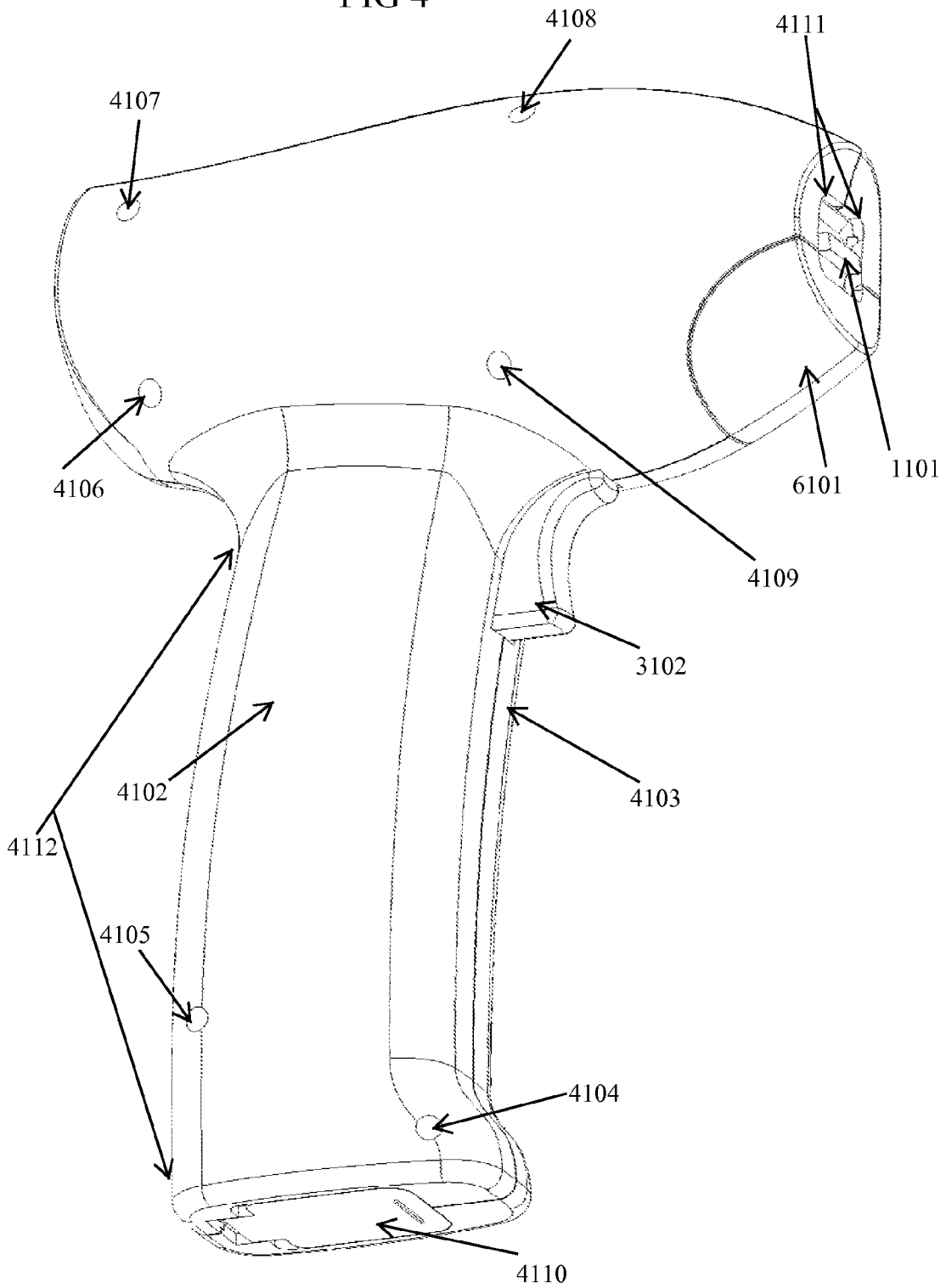

FIG. 4 is an external view from the right side of a Label Information Degrader (LID), embodiment 2. The exterior of the LID is comprised of two main housing components, a right side shell 4102 and a left side shell 4103, held together by fasteners at a first fastener location 4104, a second fastener location 4105, a third fastener location 4106, a fourth fastener location 4107, a fifth fastener location 4108, a sixth fastener location 4109, a debris access panel 6101, supported by the right side shell 4102 and left side shell 4103, and a battery access panel 4110, supported by the right side shell 4102 and left side shell 4103. Also shown is the external trigger 3102, supported by the right side shell 4102 and left side shell 4103. The right side shell 4102 and left side shell 4103 will form a small abrasion component housing opening 4111 through which the abrasion component 1101 will contact a labeled surface. A portion of the housing component may form a handle 4112, formed by the portions of the right side shell 4102 and left side shell 4103 from approximately the location of the external power switch 3102 and battery access panel 4110.

Figure 5:
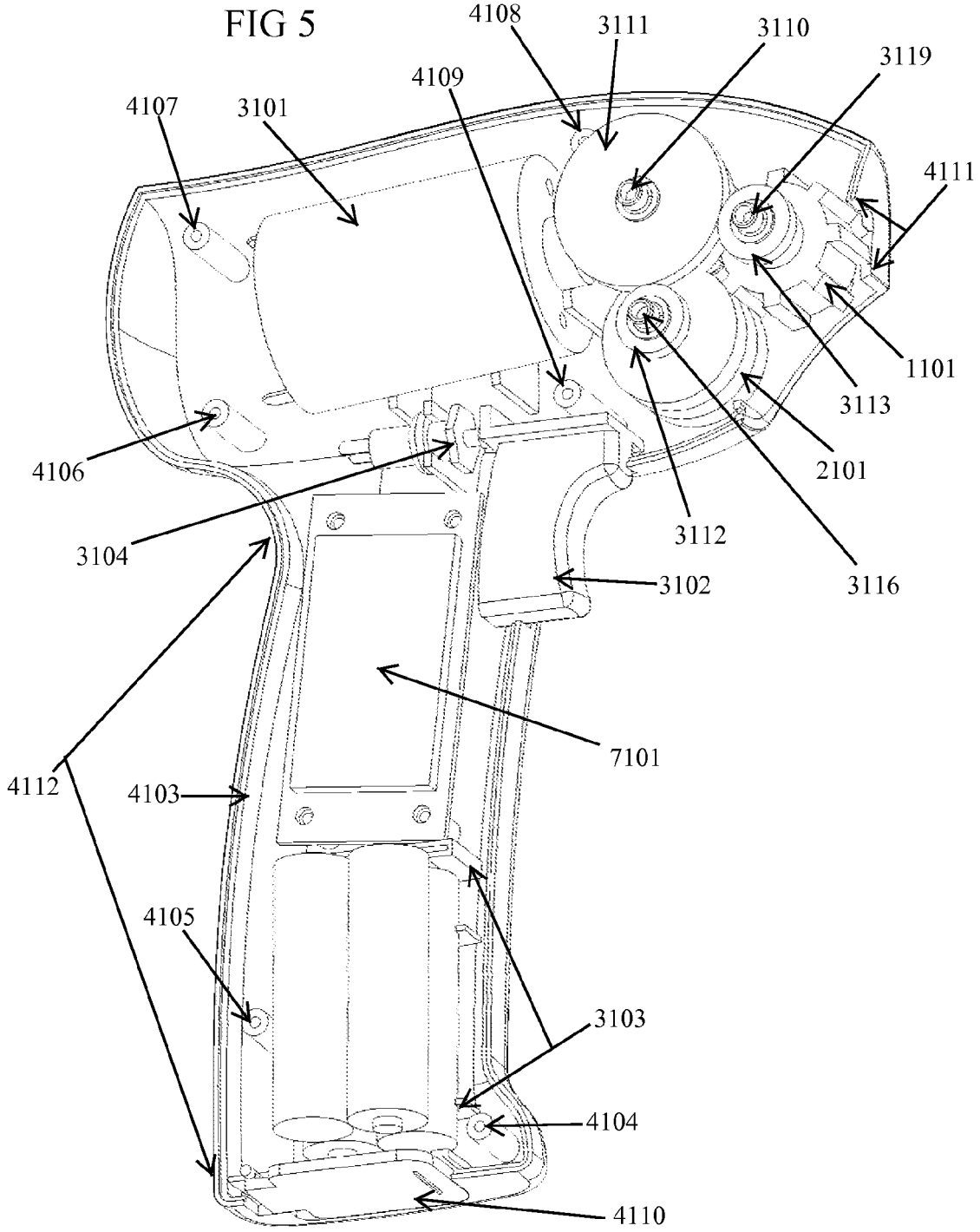

FIG. 5 is an internal view from the right side of a Label Information Degrader (LID), embodiment 2. Certain components or parts of components have been hidden to provide this view including: a right side shell 4102; a portion of the handle 4112; and a debris access panel 6101.

Figure 6:
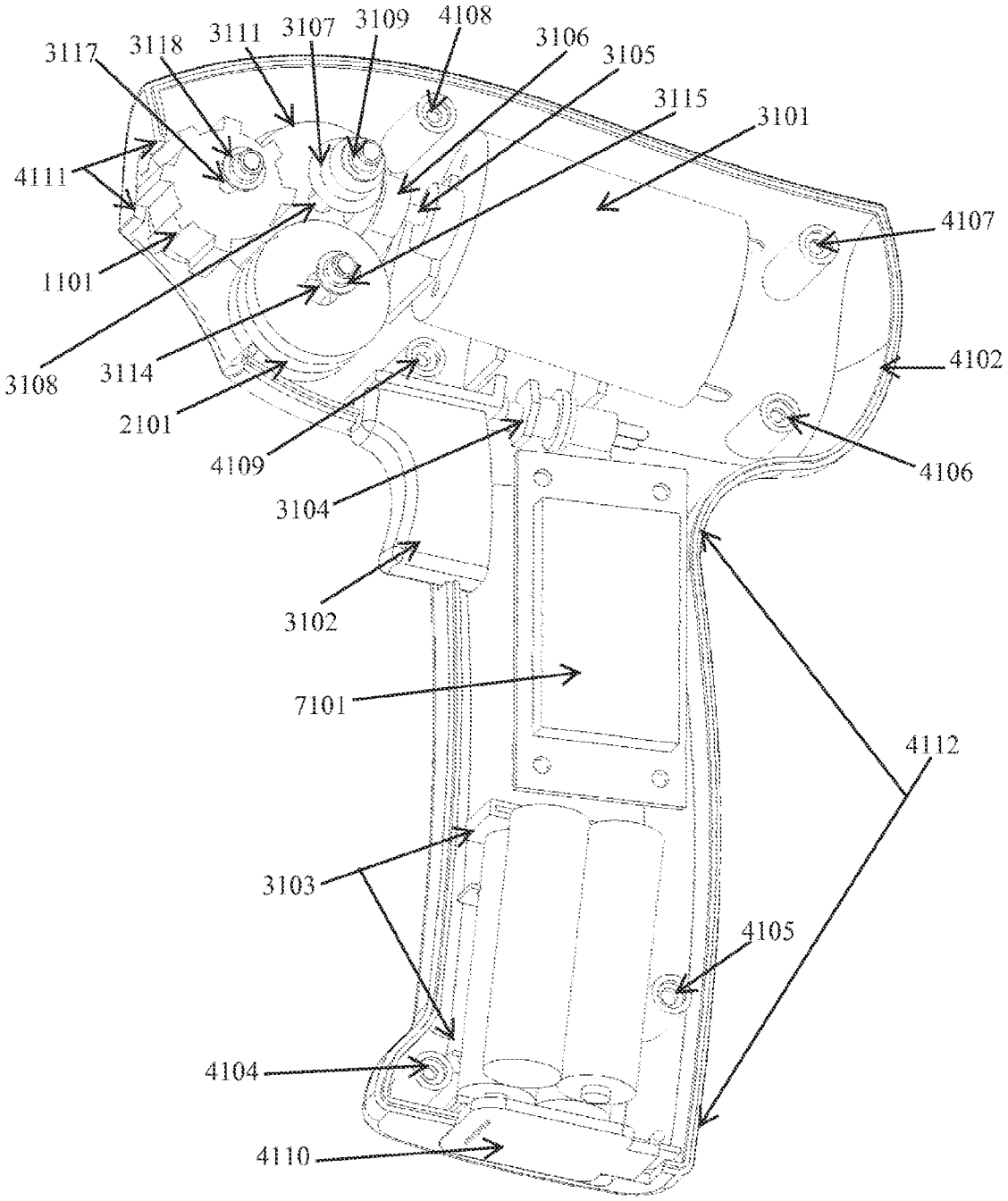

FIG. 6 is an internal view from the left side of the LID, embodiment 2. Certain components or parts of components have been hidden to provide this view including: a left side shell 4103; a portion of the handle 4112; and a debris access panel 6101.

Viewing FIGS. 5 and 6 together provides an example of how LID, embodiment 2 may be configured. Previously visible and identified components include the right side shell 4102 (shown in FIG. 6), the left side shell 4103 (shown in FIG. 5), the first fastener location 4104, the second fastener location 4105, the third fastener location 4106, the fourth fastener location 4107, the fifth fastener location 4108, the sixth fastener location 4109, the battery access panel 4110, the external power switch 3102. Internal components now visible include a battery receptacle 3103, supported by the right side shell 4102 (shown in FIG. 6) and left side shell 4103 (shown in FIG. 5), containing one or more batteries electrically connected to a pc board 7101, an internal switch 3104 supported by the right side shell 4102 (shown in FIG. 6) and left side shell 4103 (shown in FIG. 5) that is contacted by and activates when the external power switch 3102 is depressed. The internal switch 3104 is electrically connected to the pc board 7101, a motor 3101 is also electrically connected to the pc board 7101 and supported by the right side shell 4102 (shown in FIG. 6) and left side shell 4103 (shown in FIG. 5), with a motor drive shaft 3105 (shown in FIG. 6). Supported, affixed to, and rotated by the motor drive shaft is a first bevel gear 3106 (shown in FIG. 6). This first bevel gear 3106 (shown in FIG. 6) contacts and rotates a second bevel gear 3107 (shown in FIG. 6), which is supported by, affixed to, and rotates a first long shaft 3108 (shown in FIG. 6). This first long shaft long shaft 3108 (shown in FIG. 6), is supported by a first bushing 3109 (shown in FIG. 6) mounted on the left side shell 4013 (shown in FIG. 5) and a second bushing 3110 (shown in FIG. 5), mounted on the right side shell 4102 (shown in FIG. 6), which allow the first long shaft 3108 (shown in FIG. 6) to turn freely. Supported by, affixed to, and rotated by the first long shaft 3108 (shown in FIG. 6) is a first drive transfer gear 3111. This first drive transfer gear 3111 contacts a second drive transfer gear 3112 (shown in FIG. 5) and a third drive transfer gear 3113 (shown in FIG. 5). The second drive transfer gear 3112 (shown in FIG. 5) is supported by, affixed to and rotates a second long shaft 3114 (shown in FIG. 6). This second long shaft 3114 (shown in FIG. 6) is supported by a third bushing 3115 (shown in FIG. 6) mounted on the left side shell 4103 (shown in FIG. 5) and a fourth bushing 3116 (shown in FIG. 5), mounted on the right side shell 4102 (shown in FIG. 6), which allow the second long shaft 3114 (shown in FIG. 6) to turn freely. Supported by, affixed to, and rotated by the second long shaft 3114 (shown in FIG. 6) is an abrasion cleaning component 2101. The third drive transfer gear 3113 (shown in FIG. 5) is supported by, affixed to and rotates a third long shaft 3117 (shown in FIG. 6). The third long shaft 3117 (shown in FIG. 6) is supported by a fifth bushing 3118 (shown in FIG. 6) mounted on the left side shell 4103 (shown in FIG. 5) and a sixth bushing 3119 (shown in FIG. 5), mounted on the right side shell 4102 (shown in FIG. 6), which allow the third long shaft 3117 (shown in FIG. 6) to turn freely. Supported by, affixed to, and rotated by the third long shaft 3117 (shown in FIG. 6) is an abrasion component 1101. The positioning of the abrasion component 1101 and the abrasion cleaning component 2101 should be such that the abrasion cleaning component 2101 will contact and continuously clean the abrasion component 1101.

This embodiment contemplates a design where the outer edge of the abrasion cleaning component 2101 rotates at a greater speed than the outer edge of the abrasion component 1101. This may be achieved in a number of ways such as comparing the exterior diameters of the abrasion cleaning and abrasion components and then decreasing the diameter of the second drive transfer gear 3112 (shown in FIG. 5) relative to the diameter of the third drive transfer gear 3113 (shown in FIG. 5) diameter until the desired difference in rotation is achieved.

This embodiment also contemplates controlling the extent the abrasion component 1101 is permitted to penetrate through the abrasion component housing opening 4111 such that the abrasion depth is limited to the expected thickness of a label to be degraded.

The abrasion component 1101 is not depicted as a specific abrasion component. Any abrasion component will function in the LID provided the abrasion component has a surface that will degrade label information from a labeled surface and the abrasion component is configured to be mounted in the LID such that when connected to an active powered drive component, the abrasion component will rotate, contact, and degrade information from a presented labeled surface, and sufficiently accommodate the function of the other LID components. There is no specific preferred embodiment for an abrasion component, as application variables such as label material, label adhesive, surface characteristics, and others will impact the design of a preferred embodiment. Additionally, there are many possible abrasion component configurations that are compatible with the present invention, and this embodiment, and the descriptions provided in this specification are not meant to exclude or limit compatible configurations from the present invention.

The abrasion cleaning component 2101 is not depicted as a specific abrasion cleaning component. In this embodiment, the abrasion cleaning component 2101 is dynamic, driven to rotate by the LID transmission. Any abrasion cleaning component will function in the LID provided it can be positioned to remove excess debris from the abrasion contact surface or limit other surface debris accumulation on the abrasion contact surface. Additionally, there are many possible abrasion cleaning component configurations that are compatible with the present invention, and this embodiment, and the descriptions provided in this specification are not meant to exclude or limit compatible configurations from the present invention.

None of the electrical connections in the LID, such as between the battery receptacle 3103, motor 3101, and PC Board 7101, are shown. The configuration of these connections may be dependent on the specific choices of the components use to make the device. A person skilled in the art would be able to build a working device using the specification and drawings, and requirements of the selected components.

Figure 7:
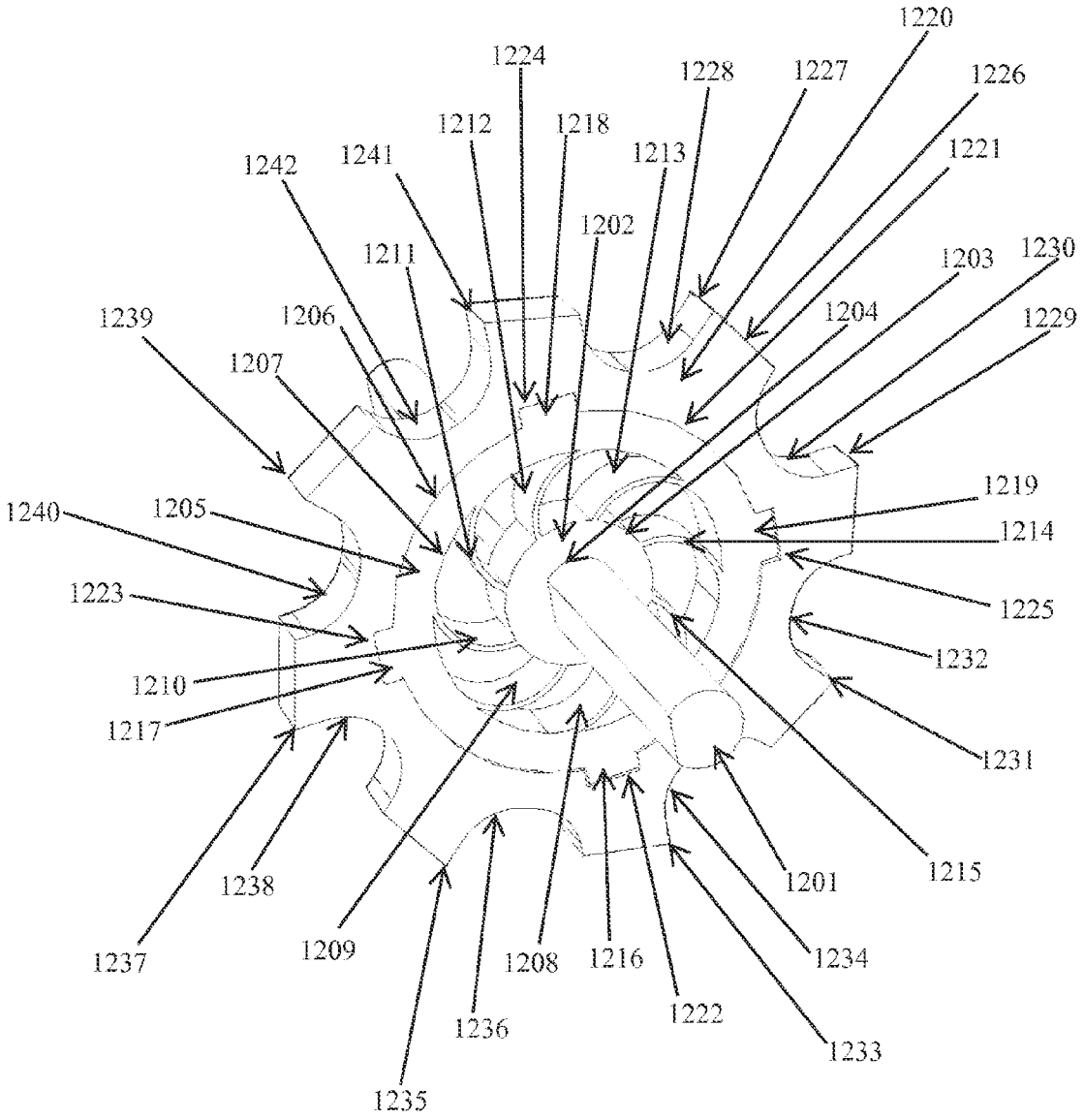

FIG. 7 is a view of an abrasion component, embodiment 1200. A long shaft 1201 having an axis of rotation, designed to receive mechanical power from the powered drive component rotates the abrasion component. In this embodiment, the abrasion component is a single an abrasion disk comprising: an inner disk 1202, with an inner disk exterior edge 1203 and an inner disk interior edge 1204, the inner disk interior edge 1204 forming an opening for the long shaft 1201, a middle disk 1205, with a middle disk exterior edge 1206 and a middle disk interior edge 1207, supported by a first flexible spoke 1208, a second flexible spoke 1209, a third flexible spoke 1210, a fourth flexible spoke 1211, a fifth flexible spoke 1212, a sixth flexible spoke 1213, a seventh flexible spoke 1214, and an eighth flexible spoke 1215, each spoke affixed at one end to the inner disk exterior edge 1203 and at the other end to the middle disk interior edge 1207, the middle disk exterior edge 1206 has a first tab 1216, a second tab 1217, a third tab 1218, and a fourth tab 1219, to facilitate rotation of an outer disk 1220, the outer disk 1220 has an outer disk interior edge 1221 with a first notch 1222, a second notch 1223, a third notch 1224, and a fourth notch 1225, each designed to receive one of the middle disk tabs, the outer disk 1220 has an outer disk exterior edge 1226 with a first abrasion edge 1227 and a first groove 1228, a second abrasion edge 1229 and a second groove 1230, a third abrasion edge 1231 and a third groove 1232, a fourth abrasion edge 1233 and a fourth groove 1234, a fifth abrasion edge 1235 and a fifth groove 1236, a sixth abrasion edge 1237 and a sixth groove 1238, a seventh abrasion edge 1239 and a seventh groove 1240, and an eighth abrasion edge 1241 and an eighth groove 1242. The abrasion edges are designed to degrade labeled surfaces while rotating and in contact with a labeled surface. The grooves are designed to reduce fouling of the abrasion edges by label or other surface debris. The number of abrasion edges, groves, and spokes may be varies according to the requirements of the abrasion component design. By varying characteristics of the spokes such as curvature, thickness, width, number and spacing of spokes, and the materials of construction, the desired level of flexibility may be achieved. This flexibility will allow the middle disk 1205 to rotate out of round with the inner disk 1202. The inner disk interior edge 1204 and long shaft 1201 may be designed to prevent the abrasion disk from sliding along the long shaft 1201 after assembly or other means such as retaining bands (not shown) may be affixed to the long shaft 1201 on either side of the abrasion disk to achieve the same effect.

Figure 8:
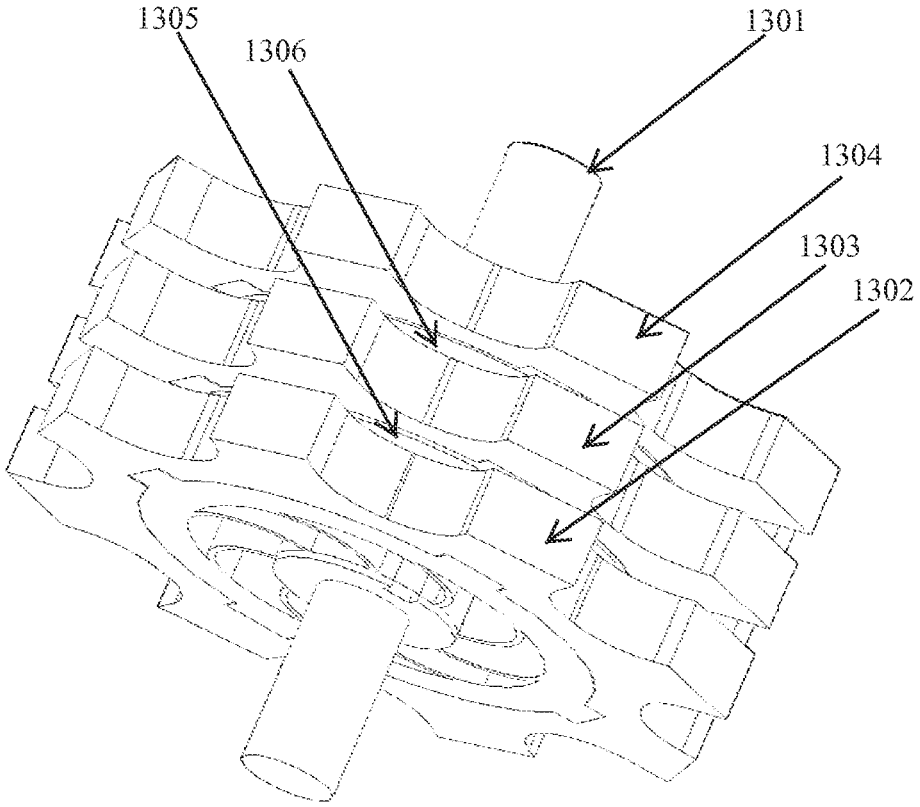

FIG. 8 is a view of an abrasion component, embodiment 1300. A long shaft 1301 having an axis of rotation, designed to receive mechanical power from the powered drive component rotates the abrasion component. In this embodiment, the abrasion component is a comprised of a first abrasion disk 1302, a second abrasion disk 1303, a third abrasion disk 1304, with a first spacer 1305 between the first abrasion disk 1302 and the second abrasion disk 1303, and a second spacer 1306 between the second abrasion disk 1303 and the third abrasion disk 1304. Each individual abrasion disk is of a design similar to the abrasion disk shown in FIG. 7. While the abrasion edges and grooves on the abrasion disks are depicted in a line, alternatively the edges and grooves could be staggered to improve performance, such as by providing a more consistent load on the motor and creating greater shear forces on the label surfaces, as well as driving label debris toward a particular location for collection. A person skilled in the art could use the enclosed specification, drawings, to construct an abrasion component of any desired width by adding additional abrasion disks and spacers.

Figure 9:
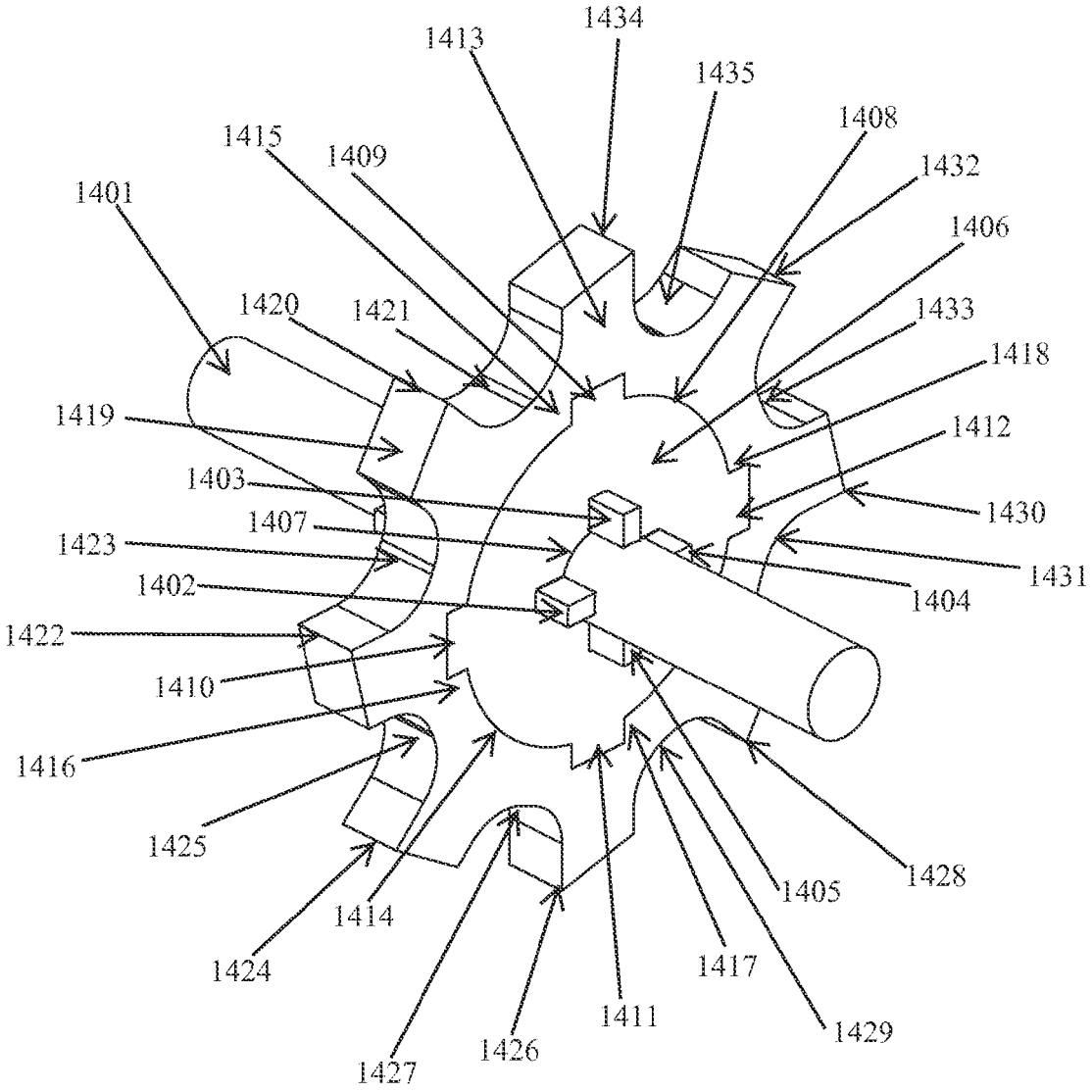

FIG. 9 is a view of an abrasion component, embodiment 1400. A long shaft 1401 having an axis of rotation, is designed to receive mechanical power from the powered drive component rotates the abrasion component. The long shaft 1401 has a first fin 1402, a second fin 1403, a third fin 1404, and a fourth fin 1405. In this embodiment, the abrasion component comprises an compressible inner disk 1406 with an inner disk interior edge 1407 with four notches each designed to fit one of the long shaft tabs, the inner disk 1406 has an inner disk exterior edge 1408, with a first tab 1409, a second tab 1410, a third tab 1411, and a fourth tab 1412, the compressible inner disk 1406 designed to elastically support and facilitate rotation of an outer disk 1413, the outer disk 1413 has an outer disk interior edge 1414 with a first notch 1415, a second notch 1416, a third notch 1417, and a fourth notch 1418, each designed to receive one of the inner disk tabs, the outer disk 1413 has an outer disk exterior edge 1419 with a first abrasion edge 1420 and a first groove 1421, a second abrasion edge 1422 and a second groove 1423, a third abrasion edge 1424 and a third groove 1425, a fourth abrasion edge 1426 and a fourth groove 1427, a fifth abrasion edge 1428 and a fifth groove 1429, a sixth abrasion edge 1430 and a sixth groove 1431, a seventh abrasion edge 1432 and a seventh groove 1433, and an eighth abrasion edge 1434 and an eighth groove 1435. The abrasion edges are designed to degrade labeled surfaces while rotating and in contact with a labeled surface. The grooves are designed to reduce fouling of the abrasion edges by label or other surface debris. By varying characteristics of the compressible inner disk 1406 such as elasticity, density, and others, the desired level of flexibility may be achieved. This flexibility will allow the outer disk 1413 to rotate out of round with the long shaft 1401. The long shaft 1401 and long shaft fins may be designed to prevent the abrasion disk from sliding along the long shaft 1401 after assembly or other means such as retaining bands (not shown) may be affixed to the long shaft 1401 on either side of the abrasion disk to achieve the same effect. A person skilled in the art could use the enclosed specification, drawings, to construct an abrasion component of any desired width by adding additional abrasion disks and spacers.

While several embodiments have been shown and described, many changes and modifications may be made, especially by selecting particular features from the descriptions above, that still result in a device within the scope and spirit of the invention.

The above-discussed embodiments of the present invention will be described further herein below. When the word "invention" or "embodiment" are used in this specification, the word "invention" or "embodiment" includes "inventions" or "embodiments," that is the plural of "invention" or "embodiment of the invention". By stating "invention" or "embodiment," the Applicant does not in any way admit that the present application does not include more than one patentably and non-obviously distinct invention, and expressly maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

What is claimed is:

1. A label information degrader device comprising:

an abrasion component; a powered drive component comprising an electric motor and an anti-stall component; an abrasion cleaning component: a user protection component; and a housing component; the abrasion component further comprising an abrasion contact surface that at least partially conforms to a labeled surface; the abrasion component further comprising a cylindrical brush with a plurality of flexible bristles; whereby outward edges of the plurality of flexible bristles form the abrasion contact surface that at least partially conforms to the labeled surface.

2. A label information degrader device comprising:

an abrasion component; a powered drive component comprising an electric motor; an abrasion cleaning component; a user protection component; a housing component; a debris collection component; and a device protection component, the device protection component comprising a PC Control Board and a reset switch.

3. The label information degrader device of claim 2 further comprising:

the device protection component further comprises a display.

4. The label information degrader device of claim 2 further comprising:

the electric motor further comprises a battery powered electric motor.

5. The label information degrader device of claim 2 further comprising:

the housing component further comprises an abrasion component housing opening; and, the abrasion component is positioned relative to the abrasion component housing opening;

whereby, the abrasion component is capable of penetrating a surface only a limited amount.

6. The label information degrader device of claim 2 further comprising:

the user protection component further comprises a compressible guard with a guard opening; and, the guard opening is positioned over the abrasion component.

7. The label information degrader device of claim 2 further comprising:

the abrasion cleaning component further comprises a static abrasion cleaning component.

8. The label information degrader device of claim 2 further comprising:

the abrasion component further comprises an abrasion contact surface that at least partially conforms to a labeled surface.

9. The label information degrader device of claim 2 further comprising:

the abrasion component further comprises a cylindrical brush with a plurality of flexible bristles;

whereby outward edges of the plurality of flexible bristles form the abrasion contact surface that at least partially conforms to the labeled surface.

10. A label information degrader device comprising:

an abrasion component; a powered drive component comprising an electric motor and an anti-stall component; an abrasion cleaning component; a user protection component; a housing component; a debris collection component; and, a device protection component; the device protection component further comprises a PC Control Board and a reset switch.

11. The label information degrader device of claim 10 further comprising:

the device protection component further comprises a display.

* * * * *